US006029348A

United States Patent [19]

Makino et al.

[11] Patent Number: 6,029,348

[45] Date of Patent: Feb. 29, 2000

[54] OIL COOLER MOUNTING STRUCTURE AND OIL COOLER MOUNTING METHOD

[75] Inventors: Kenji Makino; Haruo Ikeda; Hiroyasu Koizumi; Hideki Kobayashi; Katsumi Nakamura, all of Tokyo, Japan

[73] Assignee: Calsonic Corporation, Tokyo, Japan

[21] Appl. No.: 09/127,632

[22] Filed: Aug. 3, 1998

Related U.S. Application Data

[62] Division of application No. 08/947,938, Oct. 9, 1997, Pat. No. 5,937,938.

[30] Foreign Application Priority Data

Apr. 11, 1996 [JP] Japan ..... 8-89540
Dec. 3, 1996 [JP] Japan ..... 8-322679

[51] Int. Cl.[7] ..... H01B 19/00

[52] U.S. Cl. ..... 29/890.03; 165/140

[58] Field of Search ..... 29/890.03, 428; 165/140, 916, 76

[56] References Cited

U.S. PATENT DOCUMENTS

| | | | |
|---|---|---|---|
| 5,186,245 | 2/1993 | Peters | 165/140 |
| 5,363,910 | 11/1994 | Baba et al. | 165/153 |
| 5,645,125 | 7/1997 | Kroetsch et al. | 165/916 |
| 5,727,623 | 3/1998 | Yoshioka et al. | 165/113 |
| 5,732,769 | 3/1998 | Staffa | 165/154 |

FOREIGN PATENT DOCUMENTS

| | | | |
|---|---|---|---|
| 0457978 | 11/1991 | European Pat. Off. | F28F 9/18 |
| 0692695 | 1/1996 | European Pat. Off. | F28F 9/02 |
| 0732560 | 9/1996 | European Pat. Off. | F28D 7/10 |
| 04273995 | 9/1992 | Japan | F28F 9/02 |

*Primary Examiner*—Irene Cuda
*Attorney, Agent, or Firm*—Sughrue, Mion, Zinn Macpeak & PLLC

[57] ABSTRACT

An oil cooler mounting structure includes: a heat exchanger tank main body that is made of aluminum and has an oil cooler mounting hole in a wall surface thereof; an oil cooler that is made of aluminum, has an insertion hole for an oil introducing/discharging pipe formed in a seat portion, and is mounted inside the heat exchanger tank with a plurality of projecting pieces erected around the circumference of the insertion hole; a patch that is made of an aluminum-containing brazing filler metal and is arranged on the outer circumference of the projecting pieces of the oil cooler; and the oil introducing/discharging pipe that is inserted into the insertion hole formed in the seat portion of the oil cooler. In such oil cooler mounting structure, the oil cooler is mounted onto the heat exchanger tank main body by having the plurality of projecting pieces of the seat portion projected outside through the oil cooler mounting hole, by setting the patch through the outer circumference of the plurality of projecting pieces of the seat portion, and by bending the plurality of projecting pieces toward the patch.

5 Claims, 6 Drawing Sheets

RELATED
ART

OIL COOLER MOUNTING STRUCTURE AND OIL COOLER MOUNTING METHOD

This is a divisional of application Ser. No. 08/947,938 filed Oct. 9, 1997, now U.S. Pat. No. 5,937,938.

BACKGROUND OF THE INVENTION

1. Field of the Invention

The invention relates to the mounting of an oil cooler to a heat exchanger tank, and more particularly to a structure and method of mounting an oil cooler made of aluminum to a heat exchanger tank made of aluminum.

2. Description of the Related Art

As oil cooler incorporated heat exchangers, the following conventional examples are known. One example is characterized as brazing a heat exchanger tank and an oil cooler together as disclosed in Unexamined Japanese Utility Model Publication No. Sho. 63-17824, and another example is characterized as screwing an oil cooler onto a heat exchanger tank that is made of a synthetic resin so as to be watertight as disclosed in Japanese Utility Model Publication No. Hei. 6-43223.

In the former example, the oil cooler and a core portion of the heat exchanger can be brazed integrally, so that unlike the latter example that involves the steps of mounting the oil cooler inside the heat exchanger tank and assembling a core portion formed of a tube and a fin thereafter, the former example allows an oil cooler incorporated heat exchanger to be not only assembled in a simplified way but also provided in large quantities inexpensively.

FIG. 12 shows the oil cooler incorporated heat exchanger of the former example.

In FIG. 12, reference numeral 1 denotes an oil cooler. The oil cooler 1 has seat portions 3 on both ends thereof, and an oil cooler main body 2 is interposed between the seat portions 3. A stepped mounting surface 4 is formed on each seat portion 3. The stepped mounting surface 4 is engageable with a stepped protruding portion 6 arranged on a tank (usually, the lower tank of a heat exchanger).

The oil cooler 1 is brazed with the stepped surfaces 4 engaged with the stepped protruding portions 6 of the tank 5.

As a result of this construction, the oil cooler 1 can be incorporated into the tank 5.

It may be noted that oil introducing/discharging pipes 7 of the oil cooler 1 are brazed to the stepped protruding portions 6 of the tank 5 while engaged therewith.

However, such conventional oil cooler incorporated heat exchanger requires not only that the stepped mounting surfaces 4 be formed on the seat portions 3 of the oil cooler 1, but also that the stepped protruding portions 6 be formed on the tank 5, which increases the number of machining steps and hence makes the machining operation cumbersome.

In addition, in order to engage the stepped mounting surfaces 4 with the stepped protruding portions 6, high machining accuracies are called for. If a gap is formed between the mounting surface and the protruding portion, the brazing filler metal is not adequately spread over and may, therefore, cause defective brazing.

Further, the stepped mounting surfaces 4 must be kept engaged with the protruding portions 6 at the time of brazing, which makes the brazing operation cumbersome. If the brazing operation is performed with both members poorly engaged, the brazing material is not well spread over, which in turn causes defective brazing.

SUMMARY OF THE INVENTION

The invention has been made in view of the aforementioned conventional problems. The object of the invention is, therefore, to provide an oil cooler mounting structure and method that not only allows an oil cooler and a heat exchanger tank to be held together satisfactorily at a stage prior to brazing, but also allows a reliable brazed portion to be formed after brazing.

According to a first aspect of the invention, there is provided an oil cooler mounting structure for mounting an oil cooler inside a heat exchanger tank, comprising: a seat portion provided in the oil coller for seating the oil cooler inside the heat exchanger, a plurality of projecting pieces being erected from the seat portion and being inserted into an oil cooler mounting hole formed in a wall surface (including inside and outside) of the heat exchanger tank; wherein the plurality of projecting pieces are bent toward the wall surface of the heat exchanger tank so as to mount the oil cooler inside the heat exchanger tank.

According to a second aspect of the invention, there is provided an oil cooler mounting method inside a heat exchanger tank, comprising the steps of: arranging the oil cooler inside the heat exchanger tank; inserting a plurality of projecting pieces of a seat portion of the oil cooler into an oil cooler mounting hole formed in a wall surface of the heat exchanger tank so as to expose the projecting pieces outward from the oil cooler mounting hole; putting a pair of externally holding jigs on both side portions of the oil cooler and inside of the heat exchanger tank; fitting an internal jig into an inner space of the oil cooler; and applying a force to the projecting pieces so as to bend the projecting pieces toward the wall surface of the heat exchanger tank while the externally holding jigs and internal jig are receiving the force to prevent a deformation of the oil cooler and the heat exchanger tank.

In the first aspect of the invention, first, the oil cooler is set in the heat exchanger tank main body and the plurality of projecting pieces of the seat portions are inserted into the oil cooler mounting holes of the heat exchanger tank in such a manner that the projecting pieces are exposed outward from the holes. Incidentally, if the surface of the heat exchanger tank is not coated with a brazing filler metal, paste or powder containing the brazing filler metal is distributed adjacent to a contacted portion of the projecting pieces with the wall surface of the heat exchanger tank, or a patch which is made of an aluminum-containing brazing filler metal or of which both surfaces are coated with a brazing filler metal is arranged on an outer circumferences of the projecting pieces. Then, the plurality of projecting pieces are bent toward the wall surface of the heat exchanger tank.

When the above operations have been completed, the oil cooler can be temporarily held by the heat exchanger tank main body.

Then, a core portion is mounted on the thus prepared heat exchanger tank main body and a heat exchanger tank main body not having an oil cooler mounted thereon, and brazed integrally according to an ordinary method.

In the second aspect of the invention, first, the oil cooler is set in the heat exchanger tank main body and the plurality of projecting pieces of the seat portions are inserted into the oil cooler mounting holes of the heat exchanger tank in such a manner that the projecting pieces are exposed outward from the holes.

Then, not only the pair of externally holding jigs are put on both side portions of the oil cooler, but also the internal jig is fitted into the inner space of the oil cooler made of aluminum.

Then, the plurality of projecting pieces are bent toward the wall surface of the heat exchanger tank.

When the above operations have been completed, the oil cooler can be temporarily held by the heat exchanger tank main body.

Then, a core portion is mounted on the thus prepared heat exchanger tank main body and a heat exchanger tank main body not having an oil cooler mounted thereon, and brazed integrally. The brazing filler metal is prepared by the aforementioned manner.

DETAILED DESCRIPTION OF THE PREFERRED EMBODIMENTS

Figure 1:
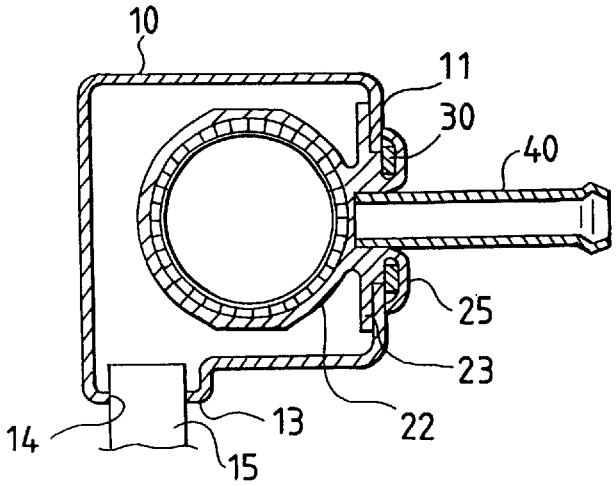
FIG. 1 is a sectional view showing an oil cooler mounting structure according to an embodiment of the present invention.

Modes of embodiment of the invention will now be described with reference to the drawings.

FIGS. 1 to 5 show an oil cooler mounting structure according to an embodiment of the present invention. In FIGS. 1 to 5, reference numeral 10 denotes a heat exchanger tank main body made of aluminum (e.g., A-3003 or the like).

Figure 2:
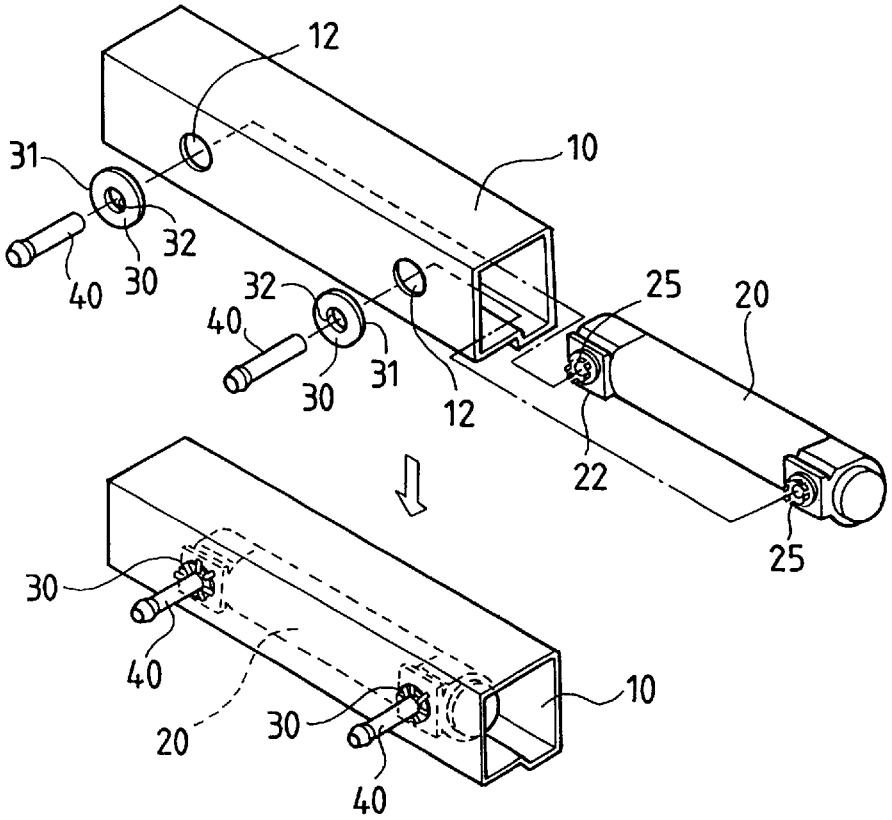
FIG. 2 is a perspective view showing an assembling condition of the oil cooler mounting structure.
Figure 3:
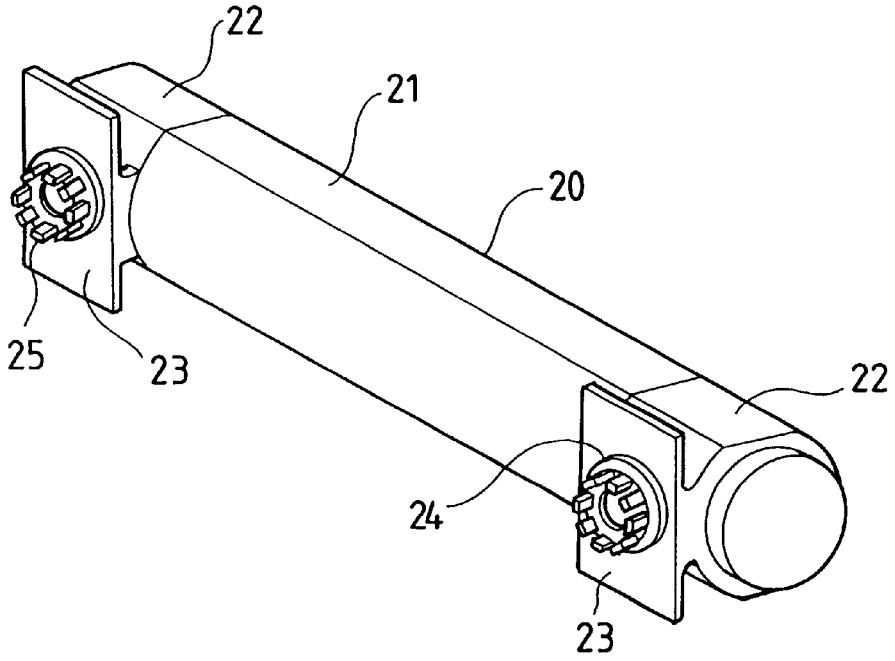
FIG. 3 is a perspective view showing an oil cooler shown in FIGS. 1 and 2.
Figure 4:
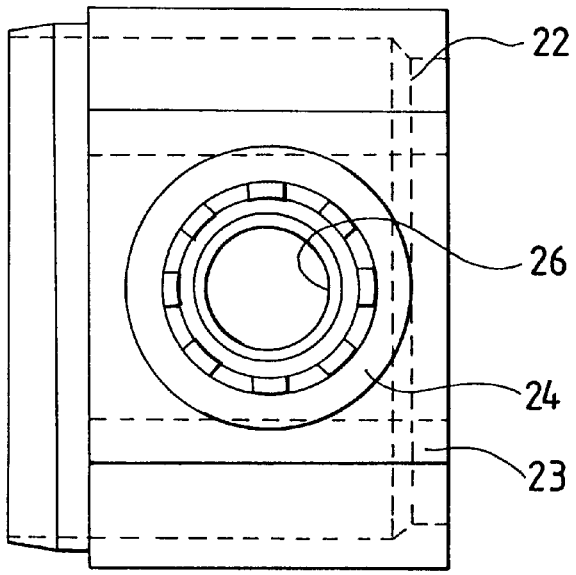
FIG. 4 is a plan view showing a seat portion of the oil cooler shown in FIGS. 1 and 2.
Figure 5:
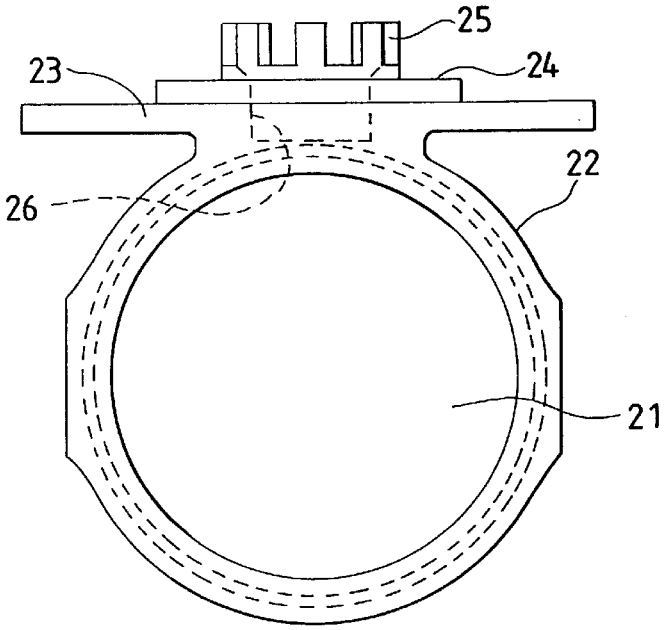
FIG. 5 is a sectional view showing the sheet portion of the oil cooler shown in FIGS. 1 and 2.

As shown in FIGS. 1 and 2, the heat exchanger tank main body 10 is box-shaped in cross section and is formed by drawing. A wall surface 11 of the tank main body 10 has two oil cooler mounting holes 12 bored therein. In this embodiment, the surface of the heat exchanger tank main body 10 is not coated with a brazing filler metal. However, it is allowed the metal sheet coated with a brazing filler metal to press-mold so as to form the heat exchanger tank main body. Or the brazing filler metal may be coated on the surface of the heat exchanger tank main body after the heat exchanger tank main body is formed by drawing.

Further, the heat exchanger tank main body 10 has an insertion hole 14 formed in a bottom surface 13 that constitutes a seat plate portion. The insertion hole 14 allows a tube 15 to be inserted thereinto.

An oil cooler 20 made of aluminum (e.g., A-3003 or the like) is mounted inside the heat exchanger tank main body 10.

The oil cooler 20 has seat portions 22 attached to both ends of a double pipe oil cooler main body 21.

Each seat portion 22 has a mounting seat 23, a projecting portion 24, a plurality of projecting pieces 25, and an insertion hole 26. The mounting seat 23 is a rectangular portion having a larger diameter than the oil cooler mounting hole 12 of the heat exchanger tank main body 10. The projecting portion 24 is formed on the mounting seat 23 and has substantially the same outer diameter as the inner diameter of the oil cooler mounting hole 12. The plurality of projecting pieces 25 are arranged annularly around the projecting portion 24 at intervals. The insertion hole 26 passes through the centers of the mounting seat 23 and the projecting portion 24. Hereupon, the projecting portion 24 may not be provided, and the projecting pieces 25 may be arranged along an inner shape of the oil cooler mounting hole 12.

Oil introducing/discharging pipes 40, each being made of aluminum and clad with a brazing filler metal (e.g., A-4343-A-3003-A-4343 or the like), are inserted into the insertion holes 26 of the seat portions 22.

Reference numeral 30 denotes an annular patch that is made of aluminum and clad with a brazing filler metal (e.g., A-4343-A-3003-A-4343 or the like).

The patch 30 has an outer edge 31 that is larger than the oil cooler mounting hole 12 of the heat exchanger tank 10, and has an inner edge 32 that is substantially the same as the outer diameter of the projecting portion 24 of the seat portion 22 of the oil cooler main body 21.

Then, the operation of the thus constructed mode of embodiment will be described.

As shown in FIG. 2, first, the oil cooler 20 is inserted into the heat exchanger tank main body 10.

Then, the plurality of projecting pieces 25 of the seat portions 22 attached to both ends of the oil cooler main body 21 are inserted into the oil cooler mounting holes 12 of the heat exchanger tank main body 10 in such a manner that the projecting pieces 25 are exposed outward from the holes 12, and the annular patches 30 are put on the outer circumferences of the projecting portions 24 of the seat portions 22 projecting from the oil cooler mounting holes 12.

Then, as shown in FIG. 1, the plurality of projecting pieces 25 are brought into contact with the corresponding patches 30 while bent outward. Further, the plurality of projecting pieces 25 are crimped without forming a gap between the mounting seat 23 of the seat seat portion 22 and the wall surface of the heat exchanger tank main body 10.

Then, the oil introducing/discharging pipes 40 are press-fitted into the corresponding insertion holes 26 of the seat portions 22.

When the aforementioned operations have been completed, the oil cooler 20 can be temporarily held by the heat exchanger tank main body 10.

Then, a core portion (formed of the tube 15 and a not shown fin) is attached to the thus prepared heat exchanger tank main body 10 and to a heat exchanger tank main body (not shown) not having an oil cooler 20 mounted thereon according to an ordinary method, and brazed integrally.

For brazing, since the patches 30 and the oil introducing/discharging pipes 40 have both surfaces thereof coated with a brazing filler metal through cladding or the like, the filler metal gets spread over the heat exchanger tank 10, the mounting seats 23 and the projecting portions 24 of the seat portions 22 of the oil cooler 20. As a result, the heat exchanger tank 10 and the oil cooler 20 can be brazed integrally.

As described above, according to this mode of embodiment, the oil cooler 20 can be temporarily held only by bending the plurality of projecting pieces 25 of the seat portions 22 on both ends of the oil cooler main body 21 onto the outer wall surface 11 of the heat exchanger tank main body 10 through the patches 30 at a stage prior to brazing. As a result, it is no longer required as in the conventional example that the shape of the heat exchanger main body and that of the seat portions of the oil cooler main body be machined with accuracy.

Further, at the time of brazing after the temporary holding, the brazing filler metal is spread over the heat exchanger tank 10 and both the mounting seats 23 and the projecting portions 24 of the seat portions 22 of the oil cooler 20, so that the heat exchanger tank 10 and the oil cooler 20 can be integrally brazed reliably.

Figure 6:
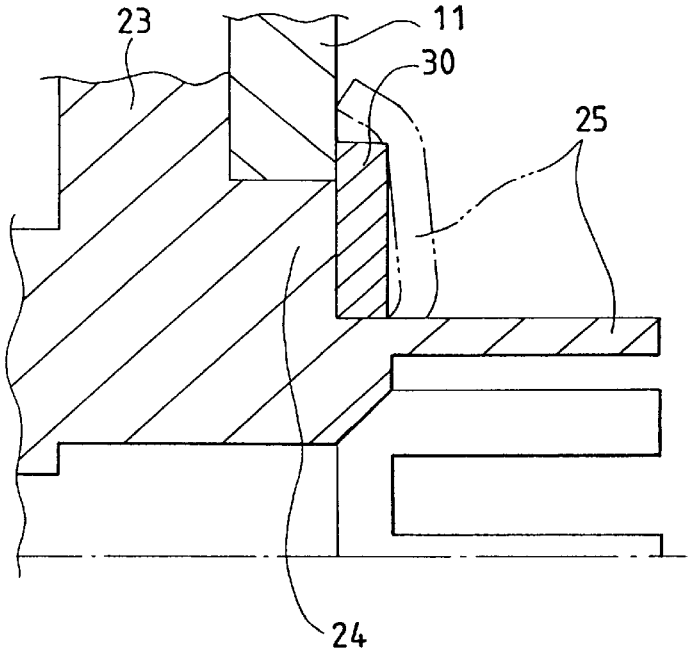
FIG. 6 is an enlarged sectional view showing a main portion of the oil cooler mounting structure.

While the case where the patch 30 is an annular plate that is made of aluminum and clad with a brazing filler metal (e.g., A-4343-A-3003-A-4343 or the like) has been described in the aforementioned mode of embodiment, the patch 30 may also be made of an aluminum-containing brazing filler metal (e.g., A-4343 or the like). Further, the patch 30 is not limited to an annular shape, but may be of any shape as long as such shape allows a brazing filler metal to be supplied at the time of brazing. Still further, if the patch 30 is made of an aluminum-containing brazing filler metal (e.g., A-4343 or the like), it is desirable that the length of each of the plurality of projecting pieces 25 of the seat portions 22 on both ends of the oil cooler main body 21 be long enough to cover the outer edge of the patch 30 as shown in FIG. 6. The reason therefor is to eliminate the danger of forming a gap. That is, since the front ends of the plurality of projecting pieces 25 come in contact with the wall surface 11 of the heat exchanger tank main body 10 directly when bent, so that the wall of the heat exchanger tank main body is sandwitched by the projecting pieces 25 and the mounting seat 23, even when a brazing filler metal flows at the time of brazing, there is no danger that a gap will be formed between the mounting seat 23 and the wall surface 11.

Further, while the case where eight projecting pieces 25 are arranged has been described in the aforementioned mode of embodiment, the number of projecting pieces 25 is not limited thereto as long as the plurality of projecting pieces 25 have such a strength as to allow the oil cooler to be temporarily held by the heat exchanger tank main body.

Further, while the case where a double pipe oil cooler main body 21 is used as the oil cooler 20 has been described, a laminated oil cooler main body may also be used.

Furthermore, while the case where a shape of the oil cooler mounting hole 12 is circular has been described, the shape of the hole 12 is not limited to circle, and may be shaped to be oval, rectangular, or the like. The outer shape of the projecting portion 24 is made correspondent to the shape of the hole 12.

Figure 7:
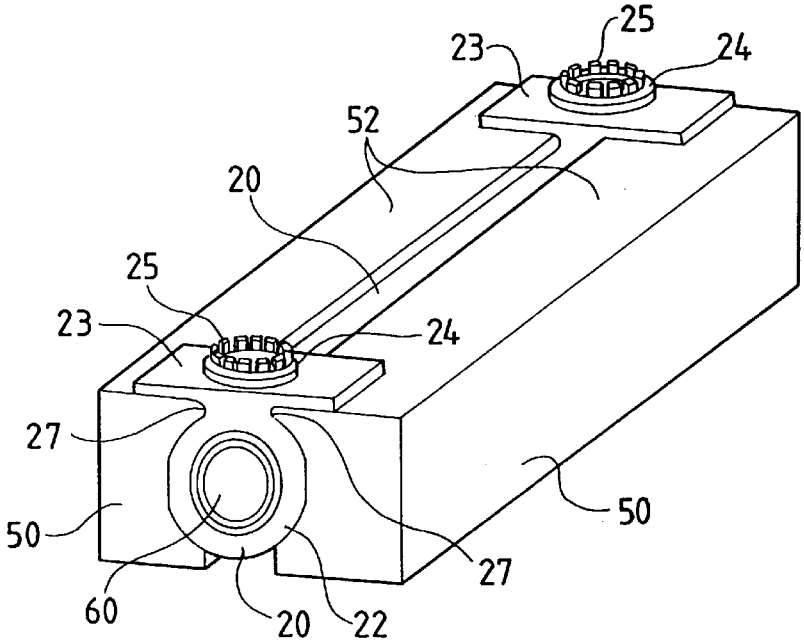
FIG. 7 is a perspective view showing a relationship among an oil cooler, a pair of externally holding jigs, and an internal jig in an oil cooler mounting method.
Figure 8:
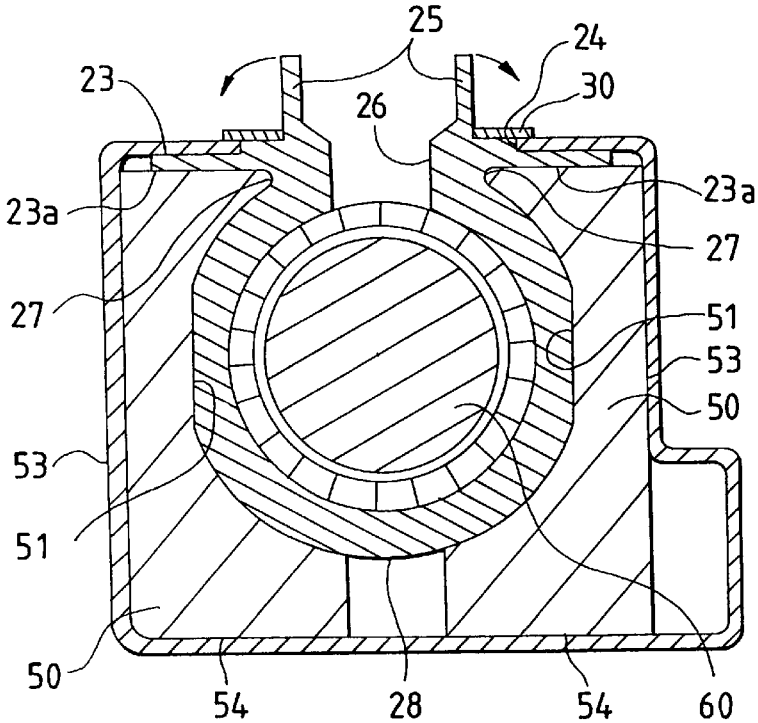
FIG. 8 is a sectional view showing a condition in which a plurality of projecting pieces are about to be bent in the oil cooler mounting method.
Figure 9:
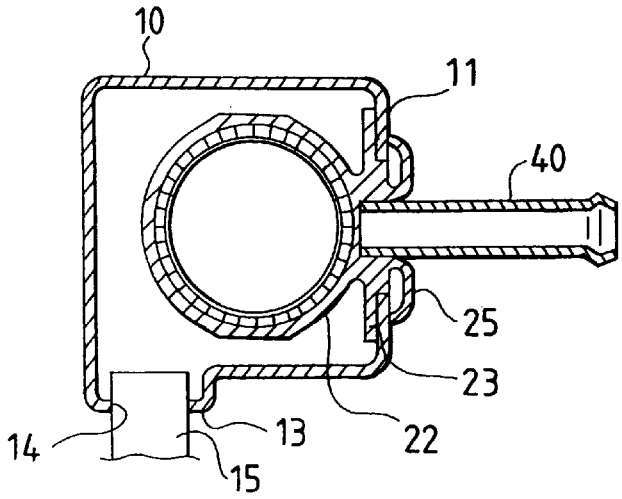
FIG. 9 is a sectional view showing an oil cooler mounting structure according to another embodiment of the present invention.
Figure 10:
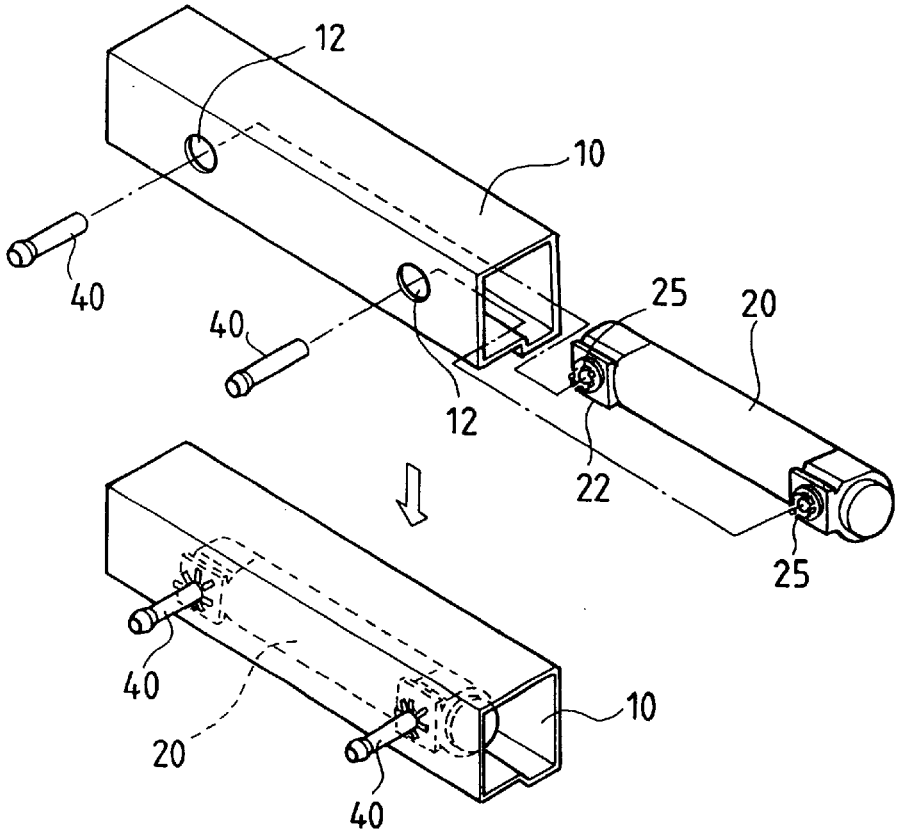
FIG. 10 is a perspective view showing an assembling condition of the oil cooler mounting structure in FIG. 9.
Figure 11:
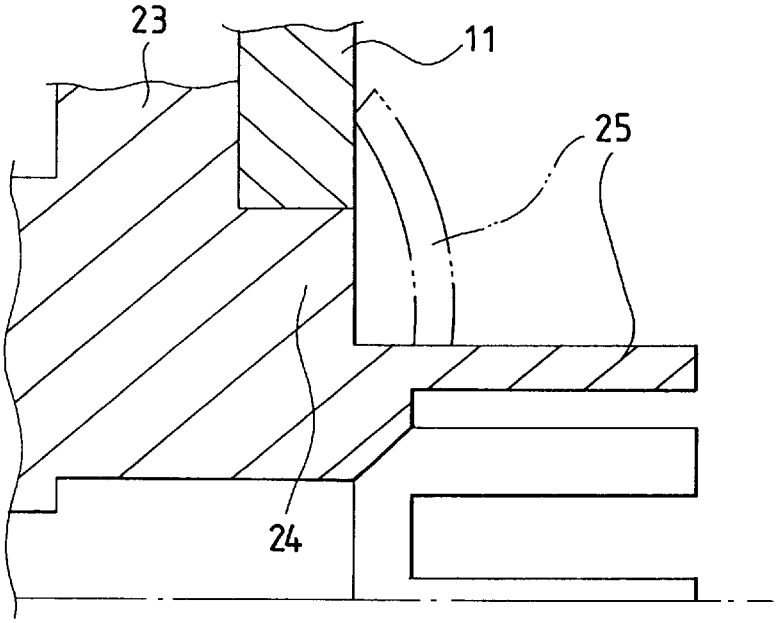
FIG. 11 is an enlarged sectional view showing an main portion of the oil cooler monting structure in FIGS. 9 and 10.
Figure 12:
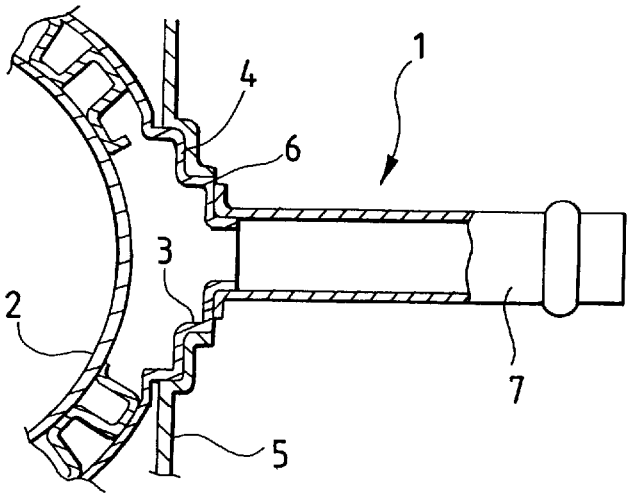
FIG. 12 is a sectional view showing a main portion of a conventional oil cooler mounting structure.

FIGS. 7 and 8 show an oil cooler mounting method according to the other embodiment of the present invention.

As shown in FIG. 2, this mode of embodiment involves the steps of: first inserting the oil cooler 20 into the heat exchanger tank main body 10; thereafter inserting the plurality of projecting pieces 25 of the seat portions 22 on both ends of the oil cooler main body 21 into the oil cooler mounting holes 12 in such a manner that the projecting pieces 25 are exposed outward from the holes 12; and then putting the annular patches 30 on the outer circumferences of the projecting portions 24 of the seat portions 22 projecting from the oil cooler mounting holes 12.

Then, not only a pair of externally holding jigs 50, 50 are put on both side portions of the oil cooler 20, but also an internal jig 60 is fitted into an inner space of the oil cooler 20.

Here, the pair of externally holding jigs 50, 50 are made of a metal that is to be used as a metal molding die. Each externally holding jig 50 has a curved portion 51, an upper surface portion 52, a vertical wall surface 53, and a bottom surface 54. The curved portion 51 extends from the mounting seat 23 to a bottom portion 28 so as to come in contact with the mounting seat 23 and the bottom portion 28, the mounting seat 23 being arranged on the seat portion 22 of the oil cooler 20 and the bottom portion 28 being located at a position opposite to the plurality of projecting pieces 25. The upper surface portion 52 receives a lower surface 23*a* of the mounting seat 23. The vertical wall surface 53 comes in contact with the inner wall surface of the heat exchanger tank main body 10. A portion between the curved portion 51 and the upper surface portion 52 is rounded along a rounded portion 27 between the seat portion 22 and the mounting seat 23.

Further, the internal jig 60 is made of a metal that is to be used as a metal molding die, and is constructed of a round rod having substantially the same outer diameter as the inner diameter of the inner space of the oil cooler 20. After fitted into the oil cooler 20, the internal jig 60 is supported by a not shown support member.

Therefore, the oil cooler 20 having the pair of externally holding jigs 50, 50 and the internal jig 60 set therein is, as shown in FIG. 8, arranged so as to be positioned by the pair of externally holding jigs 50, 50 inside the heat exchanger tank 10.

Then, as shown in FIG. 1, the plurality of projecting pieces 25 are brought into contact with the patches 30 while bent outward. Further, the plurality of projecting pieces 25 are crimped without forming a gap between the mounting seat 23 of the seat portion 22 and the wall surface of the heat exchanger tank main body 10.

Then, the oil introducing/discharging pipes 40 are press-fitted into the corresponding insertion holes 26 of the seat portions 22.

The pair of externally holding jigs 50, 50 and the internal jig 60 are thereafter taken out.

Then, similarly to the aforementioned mode of embodiment, a core portion (formed of the tube 15 and a not shown fin) is attached to the thus prepared heat exchanger tank 10 and a heat exchanger tank main body (not shown) not having an oil cooler 20 mounted thereon according to an ordinary method, and brazed integrally.

As described above, according to this mode of embodiment, the plurality of projecting pieces 25 are inserted into the oil cooler mounting holes 12 of the heat exchanger tank 10 in such a manner that the projecting pieces 25 are exposed outward from the holes 12; the annular patches 30 are put on the outer circumference of the projecting pieces 25 of the seat portions 22 projecting from the oil cooler mounting holes 12; and the pair of external holding jogs 50, 50 are thereafter put on both side portions of the oil cooler 20 when the plurality of projecting pieces 25 are brought into contact with the patches 30 by bending. Therefore, the force of the plurality of projecting pieces 25 being brought into contact with the patches 30 by bending is received by the pair of externally holding jigs 50, 50 and the internal jig 60, which in turn allows the plurality of projecting pieces 25 to be bent onto the patch 30 reliably as shown in FIG. 6 and hence excludes the possibility that a gap will be formed between the wall surface 11 of the heat exchanger tank 10 and the mounting seat 22. That is, the wall surface 11 and the mounting seats 23 of the heat exchanger tank 10 tend to be bent toward the bottom surface of the heat exchanger tank 10 as a result of the force being applied to the patches 30. However, since the lower surfaces 23*a* of the mounting seats 23 are received by the upper surface portions 52 of the pair of externally holding jigs 50, 50. Hence, the plurality of projecting pieces 25 can be bent onto the patches 30 reliably.

Therefore, the oil cooler 20 is held by the heat exchanger tank 10 reliably, and the melted brazing filler metal is spread adequately at the time of brazing, so that there is no danger of causing defective brazing.

Further, since the internal jig 60 is fitted into the inner space of the oil cooler 20, no excessive force is applied to the inner space of the oil cooler 20 at the time of bending, so that the inner space will not be deformed.

Further, since the pair of externally holding jigs 50, 50 and the internal jig 60 can be inserted from one end after the oil cooler 20 has been mounted on the heat exchanger tank 10, the assembling operation is facilitated.

While the case where the pair of externally holding jigs 50, 50 are arranged along the total length of the oil cooler 20 has been described in FIG. 7, the pair of externally holding jigs 50, 50 may also be arranged only where the seat portions 22 on both ends are located. In this case, the pair of externally holding jigs 50, 50 are to be inserted from both ends of the oil cooler 50. Further, since the pair of externally holding jigs can receive the biasing force at the positions at which the plurality of projecting pieces 25 are bent similarly to the aforementioned mode of embodiment, the pair of externally holding jigs 50, 50 can function similarly to the aforementioned mode of embodiment.

As described in the foregoing, according to the first aspect of the invention, oil cooler can be temporarily held only by bending the plurality of projecting pieces of the seat portions on both ends of the oil cooler main body onto the outer surface of the heat exchanger tank main body through the patches at a stage prior to brazing. As a result, there is no need for machining the heat exchanger tank main body and the seat portions of the oil cooler main body to specified shapes accurately as was so required in the conventional example.

Further, the melted brazing filler metal is spread over the heat exchanger tank and the seat portions of the oil cooler at the time of brazing after the temporary holding. Therefore, the heat exchanger tank and the oil cooler can be integrally brazed reliably.

According to the second aspect of the invention, not only advantages similar to those provided by the first aspect of the invention, but the following advantages can be provided as well. At the time of bending the plurality of projecting pieces, the biasing force applied thereby can be reliably received by the pair of externally holding jigs and the internal jig, so that the plurality of projecting pieces can be bent at right angles. Further, the plurality of projecting pieces can be crimped without forming a gap between the mounting seat of the mounting portion and the wall surface of the heat exchanger tank, which in turn allows the melted brazing filler metal to be well spread over at the time of integral brazing operation to be carried out thereafter.

Further, the pair of externally holding jigs and the internal jig are inserted and extracted with the oil cooler and the wall surface of the heat exchanger tank as guides. Therefore, these jigs can be handled with ease.

In the aforementioned embodiment, the heat exchanger tank main body is not coated with the brazing filler metal, so that a patch containing brazing filler metal is applied. However, as shown in FIGS. 9 to 12, the projecting pieces 25 may be bent without applying the patch 30 so as to temporarily mount the oll cooler 20 on the heat exchanger tank main body 10. Then, the paste or powder containing the brazing filler metal may be distributed adjacent to the monting hole 12. Further, when a heat exchanger tank main body coated with a brazing filler metal is used, the oll cooler 20 can be brazed to the heat exchanger tank main body 10 without applying the patch 30. That is, the patch 30 is not an essential part.

What is claimed is:

1. An oil cooler mounting method inside a heat exchanger tank, comprising:

arranging the oil cooler inside the heat exchanger tank;

inserting a plurality of projecting pieces of a seat portion of the oil cooler into an oil cooler mounting hole formed in a wall surface of the heat exchanger tank so as to expose the projecting pieces outward from the oil cooler mounting hole;

putting a pair of external holding jigs on both side portions of the oil cooler and inside of the heat exchanger tank;

fitting an internal jig into an inner space of the oil cooler; and applying a force to the projecting pieces so as to bend the projecting pieces while the external holding jigs and internal jig are receiving the force to prevent a deformation of the oil cooler and the heat exchanger tank.

2. The oil cooler mounting method according to claim 1, further comprising arranging a patch around an outer circumference of the projecting pieces projecting from the oil cooler mounting hole.

3. The oil cooler mounting method according to claim 1, wherein each of the pair of external holding jigs has a curved portion, an upper surface portion, a vertical wall surface, and a bottom surface, the curved portion extending from a mounting seat formed in the seat portion of the oil cooler to a bottom portion located at a position opposite to the projecting pieces so as to come in contact with the mounting seat and the bottom portion, the upper surface portion receiving a lower surface of the mounting seat, the vertical wall surface coming in contact with an inner wall surface of the heat exchanger tank.

4. The oil cooler mounting method according to claim 1, wherein the pair of external holding jigs are arranged along a total length of the oil cooler.

5. The oil cooler mounting method according to claim 2, further comprising crimping the projecting pieces after bending the projecting pieces.

* * * * *